US005209152A

United States Patent [19]

Olson

[11] Patent Number: 5,209,152

[45] Date of Patent: May 11, 1993

[54] AIRFOIL CHANGEOVER DEVICE

[75] Inventor: Andrew M. Olson, Villa Park, Ill.

[73] Assignee: Graco, Inc., Minneapolis, Minn.

[21] Appl. No.: 861,609

[22] Filed: Mar. 31, 1992

[51] Int. Cl.[5] ..... F01L 15/02

[52] U.S. Cl. ..... 91/50; 91/224; 91/229; 91/235; 91/321

[58] Field of Search ..... 91/50, 222, 224, 228, 91/229, 235, 321, 417; 417/403

[56] References Cited

U.S. PATENT DOCUMENTS

| | | | |
|---|---|---|---|
| 943,829 | 12/1909 | Holgate | 91/222 |
| 1,965,064 | 7/1934 | Zwayer | 91/224 |
| 2,773,483 | 12/1956 | Gal et al. . | |
| 2,846,190 | 8/1958 | Saurenman | 91/50 |
| 3,094,938 | 6/1963 | Blomeke et al. | 91/224 |
| 4,028,014 | 6/1977 | Cocks . | |
| 4,214,854 | 7/1980 | Roeder . | |
| 4,397,614 | 8/1983 | Larner . | |
| 4,780,065 | 10/1988 | Sayers . | |
| 4,821,555 | 4/1989 | Kamata et al. . | |
| 4,879,943 | 11/1986 | Grach | 91/235 |

OTHER PUBLICATIONS

"Fast Flo Pump," Copyright 1977, Graco Inc., Form No. 307-427, Jun. 1983, 20 pp.

*Primary Examiner*—Thomas E. Denion
*Attorney, Agent, or Firm*—Douglas B. Farrow

[57] ABSTRACT

An air operated reciprocating piston pump having a differential area piston is provided with an annular shaped airfoil device having a chevron cross-section and which is located beneath the bottom air intake plate to utilize increasing air velocity at the initiation of bottom changeover in order to assure more reliable changeover.

2 Claims, 1 Drawing Sheet

AIRFOIL CHANGEOVER DEVICE

BACKGROUND OF THE INVENTION

A simple air operated reciprocating piston pump of the type such as typified by Graco's FAST-FLO® pump have been known for many years. Such pumps perform an excellent job at their intended function namely the pumping for transfer purposes of basic fluids such as paints, oils and the like. Occasionally though, such pumps may be reluctant, particularly at low cycle rates, to change over from one stroke to the other.

SUMMARY OF THE INVENTION

It is therefore an object of this invention to provide a device which greatly enhances changeover of such pumps while at the same time doing so without adding excessive cost or complexity.

In this invention, an airfoil changeover device is located atop the sliding washer which slides on the piston beneath the bottom air intake plate. The airfoil has a chevron cross-section with a base facing downwards and an apex facing upwards. As the piston initiates bottom changeover, air flow velocity past the airfoil increases creating a drag force on the airfoil in the direction of the air flow. This drag force encourages the sliding valve to shift for quicker changeover.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
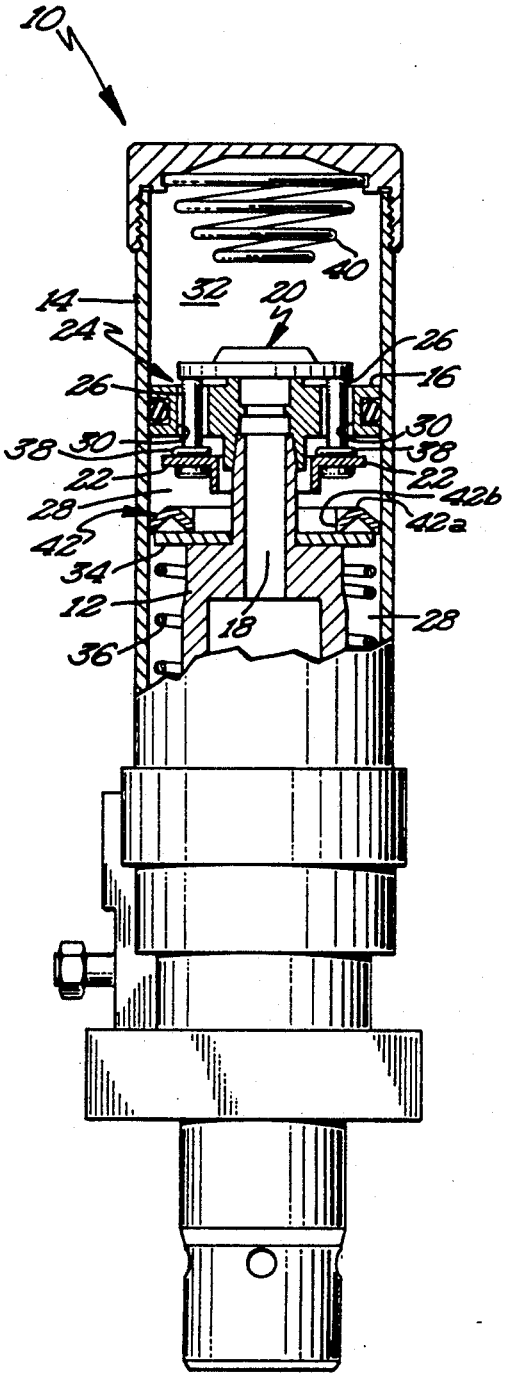
FIG. 1 is a partial section showing the device of the instant invention during the downstroke.

The device of the instant invention, generally designated 10 is a pump such as that commonly manufactured by Graco under the FAST-FLO® trademark. In pump 10, a displacement rod 12 reciprocates in a cylinder 14 and has a piston 16 attached to the top end thereof. Piston 12 has a hollow center exhaust passage 18 which is alternately covered and opened by top air intake plate 20.

Figure 2:
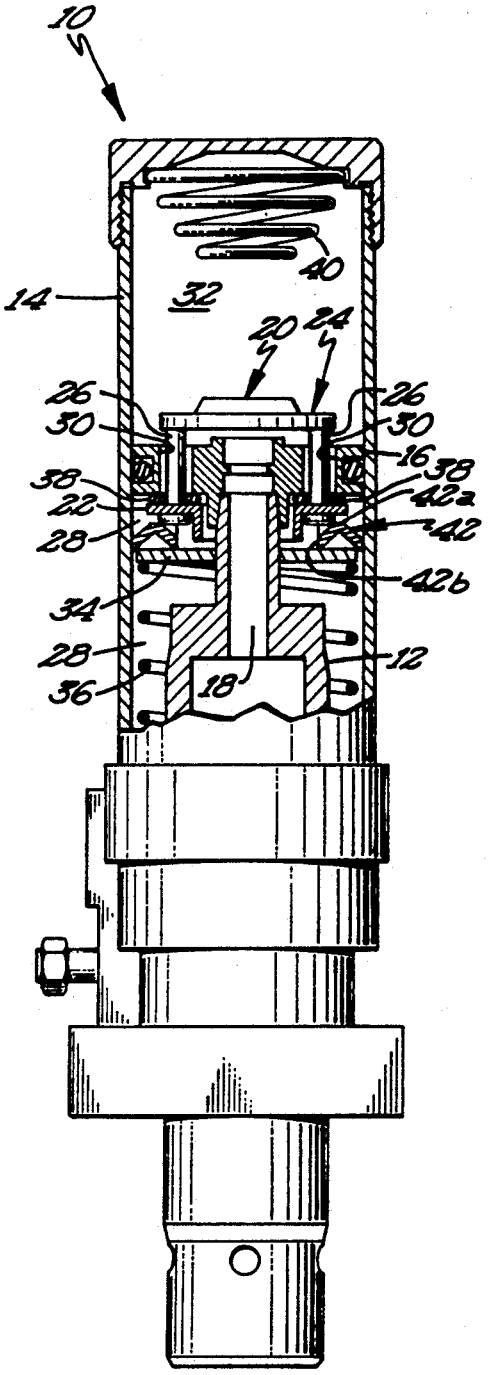
FIG. 2 is a partial section showing the device of the instant invention at bottom changeover as it starts its upward stroke.

Top air intake plate 20 in combination with bottom air intake plate 22 forms a valve assembly 24 which is lastly comprised of 3 spacers 26 (two of which are shown, the third spacer lies directly behind passage 18 in the section of FIGS. 1 and 2.)

The area of lower chamber 28 beneath piston 16 is always pressurized with air. During the downward stroke as shown in FIG. 1, this air is allowed to pass through the apertures 30 in piston 16 through which spacers 26 pass (apertures 30 being substantially larger than spacers 26) and into the upper chamber 32 above piston 16.

Because of the difference in area on which the air is able to act because of the displacement rod diameter beneath piston 16, the difference in area provides a net downward force on piston 16 which moves piston 16 downwardly.

As piston 16 approaches the bottom of the stroke, in normal prior art devices, sliding washer plate 34 would contact bottom changeover spring 36 which in turn would contact lower air intake plate 22 and forcing it upwardly thence causing O-rings 38 to seal against the bottom of piston 16. At this point, no air is allowed to pass through passages 30 with the result that pressurized air is confined to lower chamber 28 and because upper chamber 32 is allowed to vent to the atmosphere through the center passage 18 of displacement rod 12, and piston 16 travels upwardly until upward air intake plate 20 contacts upper changeover spring 40 causing the process to reverse and start again.

In the instant invention, an airfoil changeover device 42 has an apex **42*a* and a base 42*b* on an annular cross-section which surrounds and lies directly beneath lower air intake plate 22. As piston 16 nears to the bottom end of the stroke, that is as it approaches the FIG. 2 position from that shown in FIG. 1, the air velocity between changeover device 42 and cylinder 14 increases as it passes towards the center of lower intake chamber 28 thereby resulting in an upward drag force on the airfoil which is directly transferred to bottom intake plate 22** resulting in enhanced changeover.

Airfoil device 42 is most desirably formed from a TEFLON® polytetrafluoroethylene chevron-shaped packing of types commonly known and used. The air path past airfoil device 42 is mainly between it and cylinder 14 although some air may pass beneath airfoil device 42 and toward the center of chamber 28.

It is contemplated that various changes and modifications may be made to the airfoil changeover device without departing from the spirit and scope of the invention as defined by the following claims.

What is claimed is:

1. In an air-operated reciprocating piston pump having a hollow center displacement rod comprising a top end with a piston located about said top end and a valve assembly comprising top and bottom air intake plates located above and below said piston respectively, said intake plates being attached to each other by spacers passing through a plurality of circumferentially spaced air passages in said piston, the improvement comprising means for increasing and utilizing air velocity during bottom changeover to increase axial changeover force and reliability, said velocity increasing means comprising an annular airfoil comprising a chevron cross-section with a base facing axially downward and an apex facing axially upward, said airfoil being located beneath said bottom air intake plate.

2. The pump of claim 1 wherein said airfoil is comprised of polytetrafluoroethylene.

* * * * *